US005234108A

United States Patent [19]

Jorgensen

[11] Patent Number: 5,234,108

[45] Date of Patent: Aug. 10, 1993

[54] ARTIST'S ORGANIZER

[76] Inventor: Kenneth A. Jorgensen, 529 Diana St., Ogden, Utah 84403

[21] Appl. No.: 961,664

[22] Filed: Oct. 16, 1992

[51] Int. Cl.[5] ..... B65D 85/28

[52] U.S. Cl. ..... 206/575; 206/1.7; 206/214; 206/224; 220/521

[58] Field of Search ..... 206/214, 224, 371, 443, 206/564, 575, 1.7-1.9; 220/212, 521

[56] References Cited

U.S. PATENT DOCUMENTS

| | | | |
|---|---|---|---|
| 531,799 | 1/1895 | Hunt | 206/214 |
| 1,617,994 | 2/1927 | Eaton | 220/521 |
| 2,088,953 | 8/1937 | Greer | 206/214 |
| 2,228,493 | 1/1941 | Will | 206/214 |
| 2,417,879 | 3/1947 | Merritt | 206/214 |
| 2,604,372 | 7/1952 | Klinglesmith | 220/521 |
| 2,979,223 | 4/1961 | Rideout | 220/212 |
| 4,380,293 | 4/1983 | Wilcox et al. | 206/214 |
| 4,875,707 | 10/1989 | Krom | 206/214 |

FOREIGN PATENT DOCUMENTS

| | | | |
|---|---|---|---|
| 2841035 | 4/1980 | Fed. Rep. of Germany | 206/214 |
| 2232639 | 12/1990 | United Kingdom | 206/214 |

*Primary Examiner*—Jimmy G. Foster

*Attorney, Agent, or Firm*—S. Michael Bender

[57] ABSTRACT

An artist's organizer is provided comprising first and second rectangularly shaped members hinged together along a common confronting side so as to be pivotal with respect each other in the fashion of the covers of a book. The first member has a first outwardly facing surface in which are disposed a first multiplicity of receptacles for receiving and supporting therein a like multiplicity of drawing or writing instruments, and a second multiplicity of irregularly shaped receptacles for storing various artist or writing supplies, and an opposed, substantially flat second inwardly facing surface. The second member has a first surface oppositely oriented to said second surface of said first member and has peripheral sidewalls to define a bin for storing drawing paper or the like when the first and second members are closed relative to each. In alternative embodiments, a slidable plate received in a slot adjacent the first outer surface of the first member provides a protective cover for the second multiplicity of recesses therein, and a hinged pivotal auxiliary cover provides a protective cover for the first multiplicity of drawing instruments contained in the receptacles in the first surface of the first member.

8 Claims, 4 Drawing Sheets

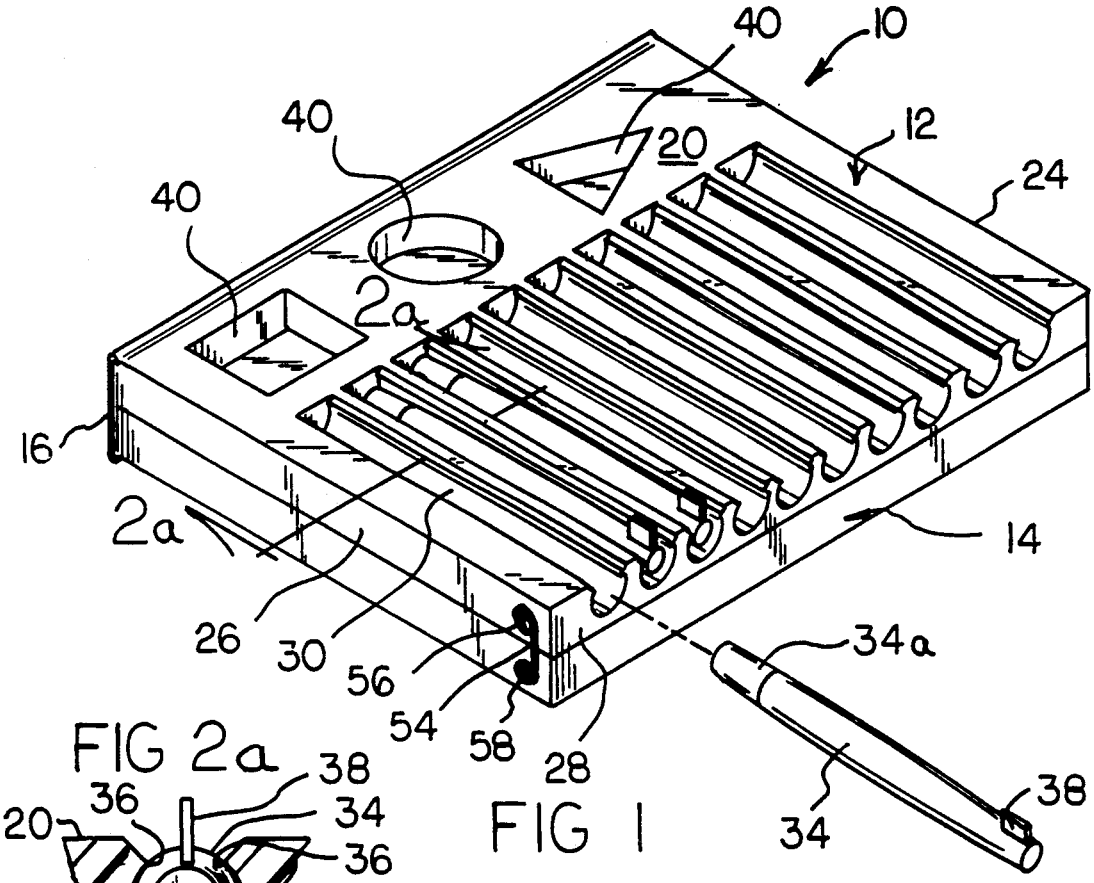
FIG 1
FIG 2a
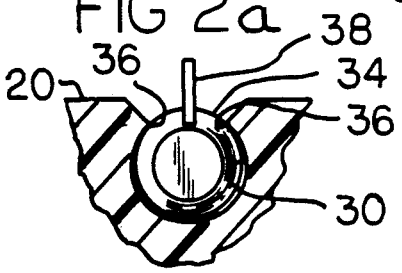
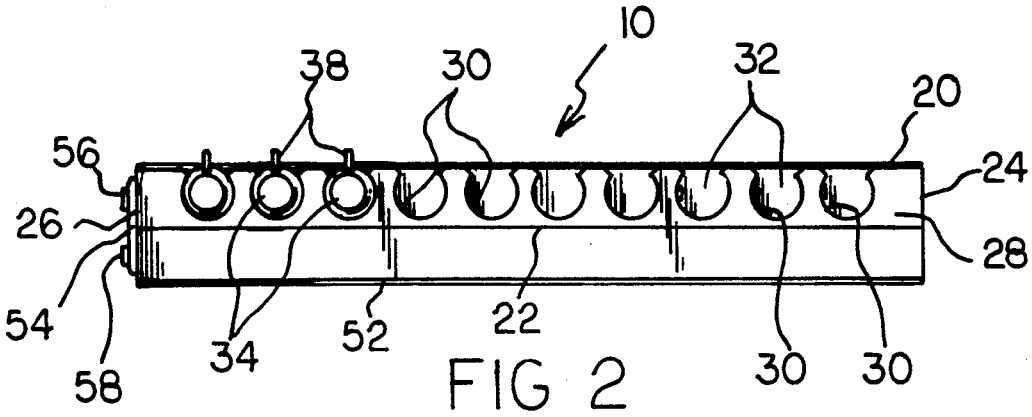
FIG 2

FIG 5
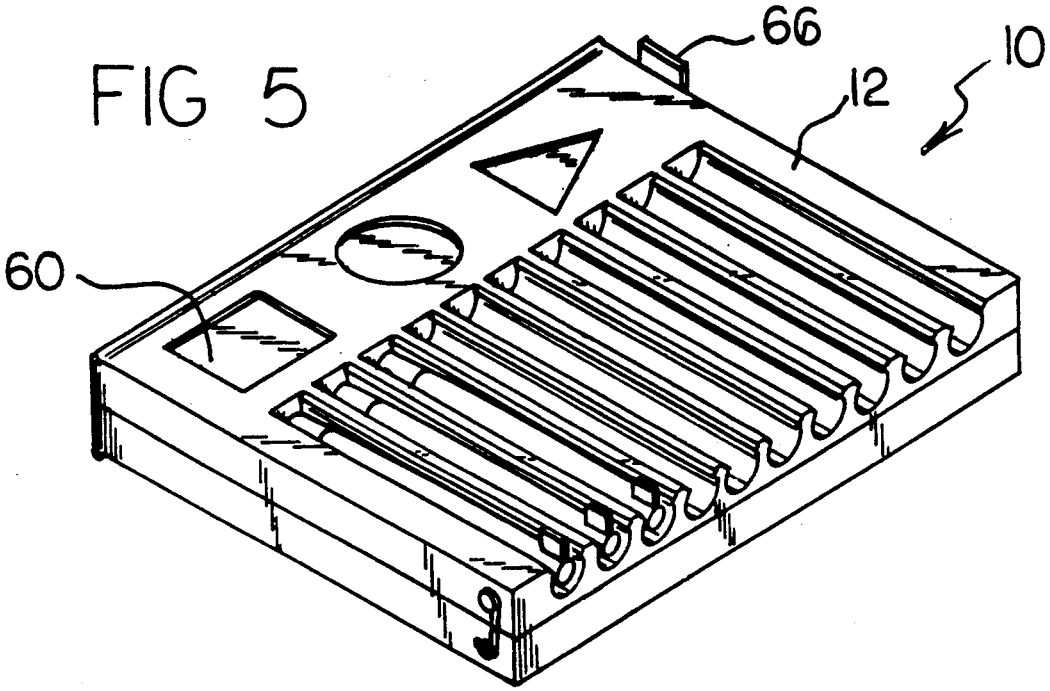
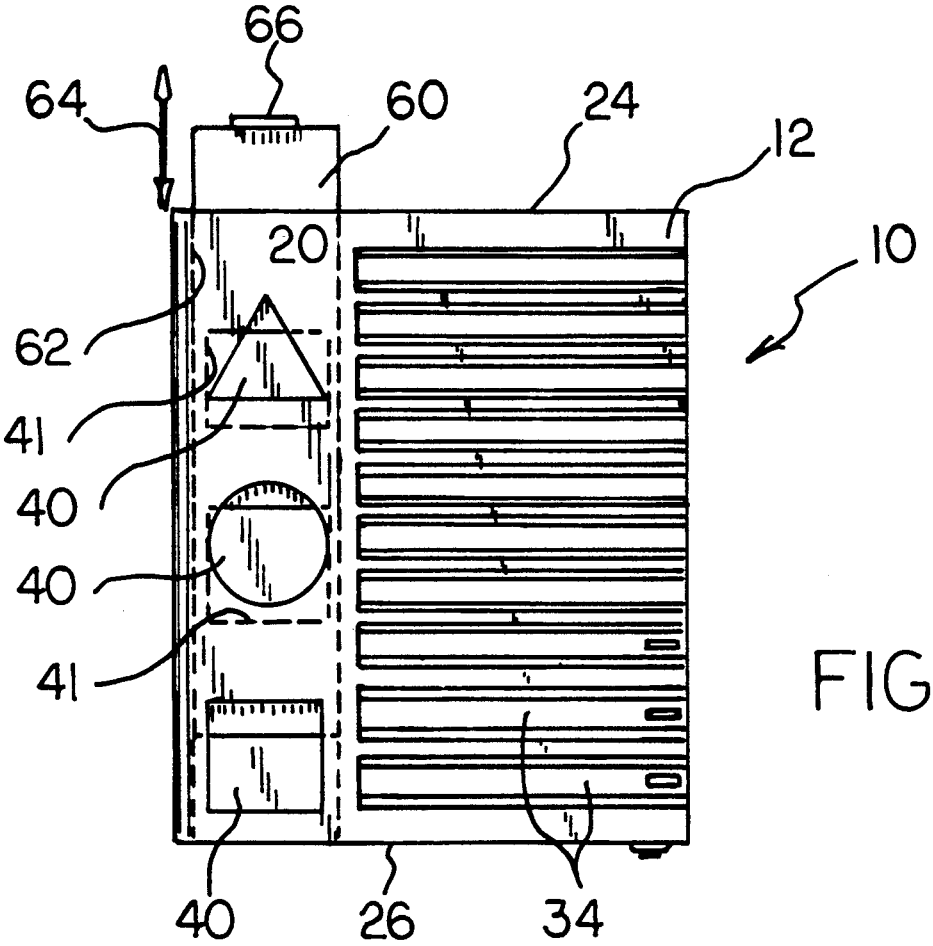
FIG 6

ARTIST'S ORGANIZER

BACKGROUND OF THE INVENTION

1. Field of the Invention

The present invention relates generally to book like structures, and more particularly, to a book like structure especially adapted to store various artist materials.

2. Description of the Prior Art

Artist materials are frequently stored in their own containers, i.e. marking pens or colored pencils in the individual boxes in which they are sold, sheets of sketching paper in a tablet or loose packet, and so on. When it is desired to transport such materials, or store them for future use, they frequently are placed in a haphazard manner in a book bag, briefcase, or other portable conveyance. A continuing need exists for storing artist materials in an organized manner so that the materials are readily available when and where needed, and further so that the materials may efficiently be transported say from the home to school or an office and vice versa. This need is met by the unique artist materials "book like" organizer contemplated by the present invention as will be made apparent from the following more complete description thereof. Other advantages of the present invention over the prior art also will be rendered evident in the ensuing discussion.

SUMMARY OF THE INVENTION

To achieve the foregoing and other advantages, the present invention, briefly described, provides an artist's organizer comprising first and second rectangularly shaped members hinged together along a common confronting side so as to be pivotal with respect each other in the fashion of the covers of a book. The first member has a first outwardly facing surface in which are disposed a first multiplicity of receptacles for receiving and supporting therein a like multiplicity of drawing or writing instruments, and a second multiplicity of irregularly shaped receptacles for storing various artist or writing supplies, and an opposed, substantially flat second inwardly facing surface. The second member has a first surface oppositely oriented to said second surface of said first member and has peripheral sidewalls to define a bin for storing drawing paper or the like when the first and second members are closed relative to each. In alternative embodiments, a slidable plate received in a slot adjacent the first outer surface of the first member provides a protective cover for the second multiplicity of recesses therein, and a hinged pivotal auxiliary cover provides a protective cover for the first multiplicity of drawing instruments contained in the receptacles in the first surface of the first member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least three preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved artist's organizer which has all of the advantages of the prior art and none of the disadvantages.

It is another object of the present invention to provide a new and improved artist's organizer which may be easily and efficiently manufactured and marketed.

It is a further objective of the present invention to provide a new and improved artist's organizer which is of durable and reliable construction.

An even further object of the present invention is to provide a new and improved artist's organizer which is susceptible of a low cost of manufacture with regard to both materials and labor, and which accordingly is then susceptible of low prices of sale to the consuming public, thereby making such artist's organizer available to the buying public.

Still yet a further object of the present invention is to provide a new and improved artist's organizer capable of housing a wide assortment of artist materials in a book like structure.

It is still a further object of the present invention is to provide a new and improved artist's organizer adapted to provide a portable storage facility for a wide variety of artist materials or writing instruments.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein:

FIG. 1 is a perspective view showing the first preferred embodiment of the artist's organizer of the invention.

FIG. 2 is a front elevational view of the artist's organizer of FIG. 1.

FIG. 2A is an enlarged detail of a portion of FIG. 2 showing the marking instrument frictional engagement means.

FIG. 5 is a perspective view showing the second preferred embodiment of the artist's organizer of the invention.

FIG. 6 is a plan view of the second preferred embodiment of the invention shown in FIG. 5.

DESCRIPTION OF THE PREFERRED EMBODIMENT

With reference now to the drawings, a new and improved artist's organizer embodying the principles and concepts of the present invention will be described.

Figure 3:
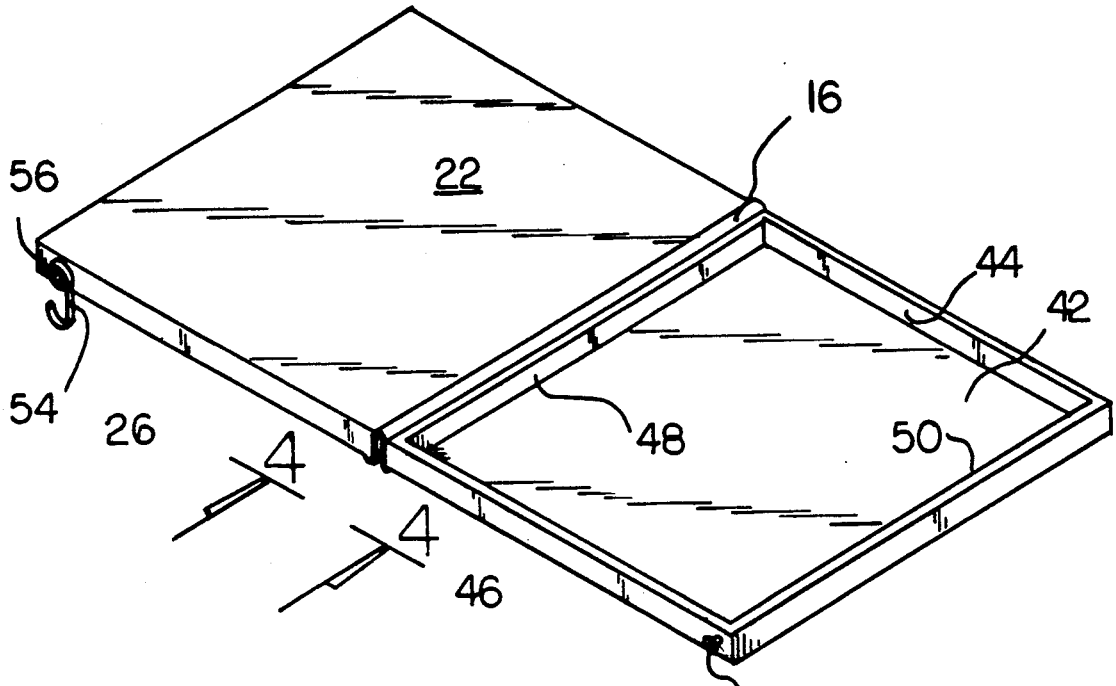
FIG. 3 is a perspective view showing the first preferred embodiment of the artist's organizer of the invention in an open position.
Figure 4:
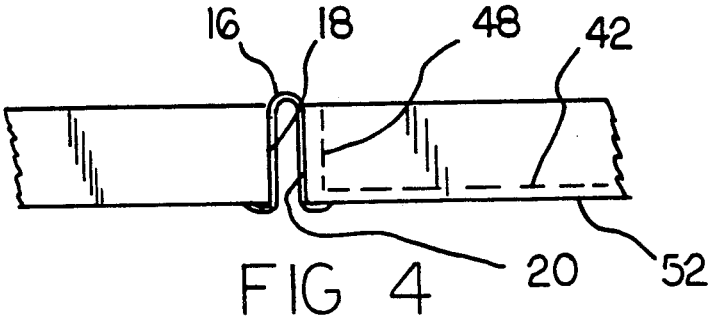
FIG. 4 is a front elevational view of an enlarged portion of the first preferred embodiment of the invention shown in FIG. 3.

Turning initially to FIGS. 1–4, there is shown a first exemplary embodiment of the artist's organizer according to the invention generally designated by reference numeral 10. In its preferred form, artist's organizer 10 comprises generally a "book like" structure having a first member 12 attached to a second member 14 by means of a flexible binding or hinge 16 extending between confronting side edges 18 and 20 so that the first and second members may be pivotally opened and closed with respect to each other about an axis defined by the longitudinal extent of hinge 16 as shown in FIGS. 1 and 3, respectively.

In the preferred embodiment, first and second members 12, 14 are fabricated in a known manner from a molded polymeric material such as acrylic, polyvinyl chloride or polypropelene so as to be rigid and durable, whereas hinge 16 is fabricated suitably of polymeric material such as polyethylene, or of woven fabric so as to be flexible. The hinge 16 is attached to side edges 18 and 20 by a suitable known adhesive, for example, in the manner of FIG. 4.

Referring to FIGS. 1 and 3, first member 12 is of substantially rectangular shape and has a first outside surface 20, an opposed inside surface 22, opposed top and bottom edges 24, 26 and a side edge 28 opposed to hinged side edge 18. It will be noted that the first member 12 has a thickness sufficient to enable the formation of various material holding receptacles in first outside surface 20. Thus, as best seen in FIGS. 1, 2 and 2a, there is provided a first multiplicity of receptacles each designated by reference numeral 30 and each being substantially cylindrical in cross-sectional shape. Each receptacle has a rear end wall 32 and an opening in side edge 28. In accordance with the invention, receptacles 30 are adapted to slidably receive a corresponding writing or drawing instrument 34 such as a marking pen or the like, each preferably of a different color. In order to provide means for maintaining the drawing instruments securely seated in their corresponding receptacles, the diameter of each receptacle is slightly tapered as the receptacle's longitudinal extent approaches rear end wall 32. In addition, the upper portion of each cylindrical recess 30 is intercepted by a V-shaped notch to define a pair of opposed longitudinally extending gripping edges 36 substantially as shown in FIG. 2A. By this arrangement, each drawing instrument 34 will be frictionally engaged by gripping surfaces 36 when it is slidably inserted into its corresponding receptacle thereby providing an effective retention of the drawing instrument securely therein, all of the while facilitating easy withdrawal of a selected drawing instrument from its corresponding receptacle. Although any conventional drawing or writing instrument may be employed with the invention, it is perferred that the organizer contemplated herein be provided with its own custom set of such tubular marking implements, in which case a finger tab 38 may be molded in the position shown to facilitate insertion and withdrawal into and out of receptacles 30.

It will be observed that in the preferred embodiment of the invention, receptacles 30 are arranged generally in front surface 20 of first member 12 in a parallel spaced manner. This arrangement not only efficiently utilizes the available space on surface 20, but furthermore, enables the user to easily and rapidly visually scan the array to choose selected colors. In this regard, it is preferred that the writing or drawing instruments 34 be color-coded as by providing differently colored caps 34a thereon, for example. It will be noted further that the rear end walls 32 of the receptacles are aligned and repose transversely a sufficient distance from hinged side edge 18 to provide space for a second multiplicity of spaced receptacles each designated by reference numeral 40 and each of which latter, substantially as shown, are of different geometrical shape. In accordance with the invention, receptacles 40 advantageously serve as repositories for various writing or artist materials, such as clips, pins, transparent tape, bottles of liquid erasure, and so on. Hence, when positioned as shown in FIG. 1, the organizer of the invention provides a convenient supporting work surface for the user.

Turning to FIG. 3, second member 14 is substantially similar to first member 12 in overall shape and size, but differs by having a single large rectangular receptacle 42 in a first surface thereof. Thus receptacle 42 defines a top wall 44, an opposed bottom wall 46, and opposed side walls 48, 50. According to the invention, receptacle 42 serves as a bin for storing drawing materials such as paper, sketch pads, or the like; the loose artist or work articles such as those placed in receptacles 40 when the user is drawing or otherwise working; or any other personal articles of the user capable of fitting in bin receptacle 42. In this regard, it will be appreciated that both the first member and the second member have substantially flat second or bottom surfaces 22, 52 respectively, and it is within the purview of the invention for the user to employ either of these as a work surface to draw or write upon depending upon the relative pivotal orientation of members 12, 14 at any given moment.

When traveling, the organizer of the invention is especially suitable as a carrying case and thus is provided with closure means in the form of a pivotal hook 54 attached to side edge 26 via a suitable fastener and which is adapted for selective engagement with a pin 58 suitably secured to outside edge of wall 46 substantially as shown. Hook 54 may be pivotally engaged or disengaged with pin 58 to close or open members 12, 14 relative to each other as desired in a manner believed apparent.

Turning to FIGS. 5 and 6 wherein like parts are represented by like reference numerals, there is shown a slightly modified version of the invention comprising a slidable cover plate 60 adapted for axial movement in a suitable slot 62 opening into top edge 24. Slot 62 is positioned proximal to surface 20 and is wide enough to overlie receptacles 40. It should be apparent that cover plate 60 may thus be slidably displaced in the direction of arrow 64 to permit access to receptacles 40 and to provide closure means for same, respectively. In this connection cover plate 60 has a pair of rectangular cut-outs 41 so that access to receptacles 40 may be had without completely withdrawing plate 60 from its slot 62. If desired, the edge of plate 60 proximal to the opening of slot 62 in side edge 24 may be provided with a handle to facilitate sliding movement of plate 60 in slot 62. In addition, plate 60 is preferably fabricated of a transparent polymeric material so as to enable the user to visual what, if any articles are stored in receptacles 40 when cover plate is in its closed position, as substantially shown in FIG. 5.

Figure 7:
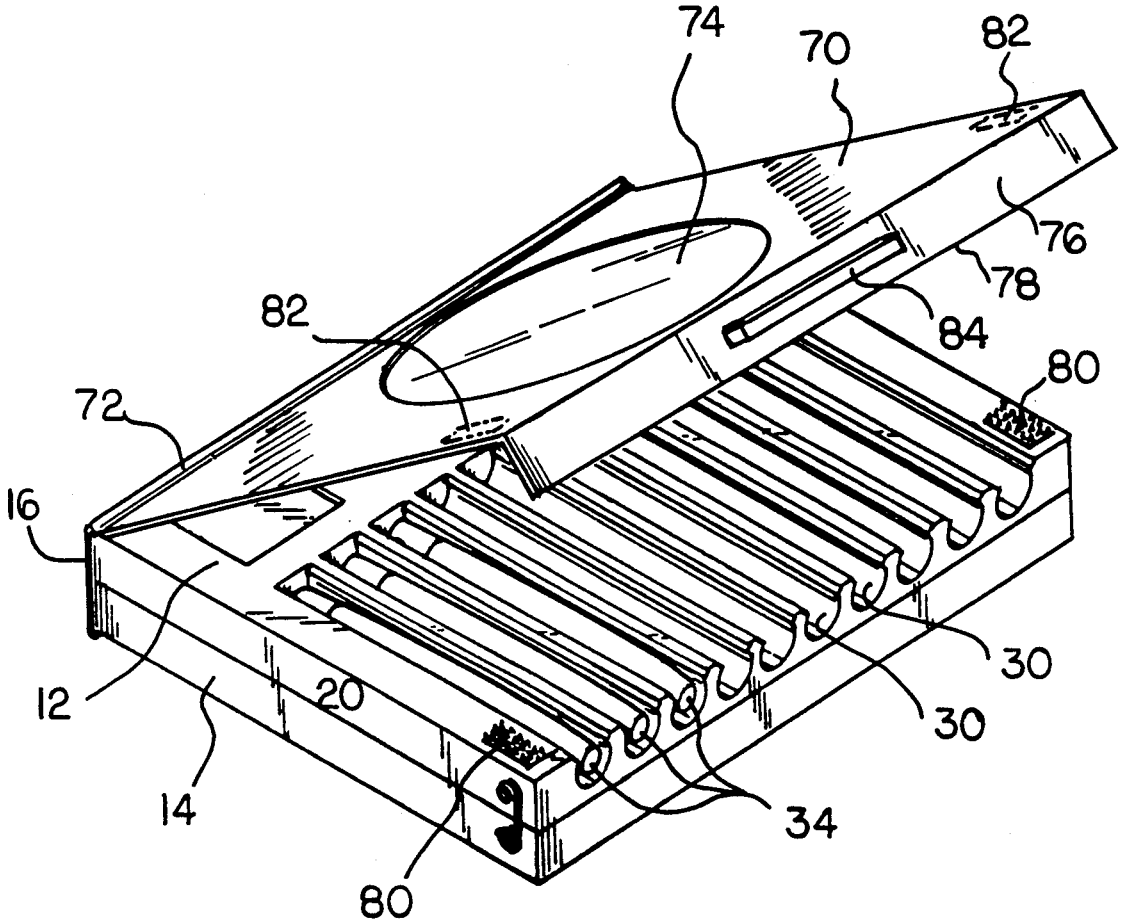
FIG. 7 is a plan view of the second preferred embodiment of the invention shown in FIG. 5.

Turning finally to FIG. 7, there is shown yet another modified version of the invention wherein again like reference numerals represent like parts. In this alternatively preferred embodiment, a cover 70 is attached to hinge 16 along one edge 72 thereof so as to be pivotally movable with respect to the surface 20 of the first member 12. Cover 70 preferably is suitably fabricated of an opaque or translucent polymeric material and has a circular transparent central section 74 substantially as shown to serve as a window through which art work or other visual material may be displayed. Cover 70 is sized to be substantially coextensive with surface 20 of first member 12 and has a right-angled edge extension 76 having substantially the same transverse extent as the thickness of member 12. Hence, in the closed position of cover 70 the longitudinal edge 78 of right-angle extended portion 76 lies more or less coextensively with the parting line between the first member 12 and the second member 14. Means are provided in the form of conventional hook and loop mating fabric fastener elements 80 and 82 so that in the closed position cover 70 is securely fastened to first member 12, but may be pivotally opened relative thereto by pulling the cover 70 upwardly with respect to the first member 12. A handle 84 suitably attached to portion 76 is provided to facilitate such opening and closing maneuvers. It is to be realized that cover 70 in the closed position serves to further retain the writing instruments 34 in their corresponding receptacles 30.

It is believed apparent from the above description that the present invention accomplishes all of the objectives set forth by providing a new and improved artist's organizer adapted to provide a portable storage facility for a wide variety of artist or writing materials and instruments.

With respect to the above description, it should be realized that the optimum dimensional relationships, for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims. For example, although the preferred embodiments comprise a generally book-like structure of rectangular shape, it will be apparent that other polygonal shapes may be employed instead, i.e. the first and second members 12, 14 may be in the shape of a square, triangle, circle, hexagon, and so on.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as encompass all such modifications and equivalents.

What is claimed as being new and desired to be protected by Letters Patent of the United States is as follows:

1. An artist's organizer comprising;

first and second members, hinge means for hinging together said first and second members along a common confronting side such that said first and second members are pivotal with respect each other, said first member having a first surface in which are disposed a first multiplicity of receptacles for receiving and supporting therein a like multiplicity of drawing or writing instruments and a second multiplicity of receptacles for storing various articles, and a second opposed substantially flat surface, said second member having a first surface oppositely oriented to said second surface of said first member and having peripheral sidewalls to define a bin for storing drawing paper or other articles when the first and second members are in a closed position defined by said second surface of said first member overlying and engaging said first surface of said second member to thereby enclose said bin, wherein said first multiplicity of receptacles comprise at least one receptacle having a cylindrical shape, said at least one receptacle extending between an opening in the side of said first member opposite to said hinge means and an end wall intermedially of said first member, said receptacle including means for frictionally engaging a writing or drawing instrument received therein by insertion through said opening.

2. The invention of claim 1 wherein said means for frictionally engaging comprises a taper in the side wall defined by said cylindrical shape, said taper resulting in a gradual reduction in the diameter of said receptacle as said receptacle extends longitudinally toward said end wall.

3. The invention of claim 2 wherein said second multiplicity of recesses are located in said first surface between said hinge means and said end wall.

4. The invention of claim 3 wherein said first and second members include cooperating closure means for releasably maintaining said first and said members in said closed position.

5. The invention of claim 3 wherein said first member includes a slot positioned proximal to said first surface thereof in intercepting relation to said second multiplicity of recesses, and slidable cover plate means disposed in said slot.

6. The invention of claim 5 wherein said cover plate means includes a pair of cutouts for permitting access to a corresponding pair of said second multiplicity of receptacles upon slidable movement of said cover plate means in said slot.

7. The invention of claim 2 further including a cover substantially coextensive to said first member's first surface, said cover having a pair of opposed edges, one of said edges being connected to said hinge means and the other of said edges having an integral edge portion extending at a right angle thereto, whereby said cover may be pivotally moved into engagement with the first surface of said first member with its integral edge portion overlying said opening in the side of said first member, and means for releasably maintaining said cover in said engaged position.

8. The invention of claim 7 wherein said means for releasably maintaining comprises at least one pair of cooperating hook and loop mating fabric fastener elements disposed on said cover and said first surface respectively.

* * * * *